US008521403B2

(12) United States Patent
Cook

(10) Patent No.: US 8,521,403 B2
(45) Date of Patent: Aug. 27, 2013

(54) SYSTEM FOR DISABLING ENGINE THROTTLE RESPONSE

(75) Inventor: Donald R. Cook, Ventura, CA (US)

(73) Assignee: Sean J. O'Neil, Santa Barbara, CA (US)

( * ) Notice: Subject to any disclaimer, the term of this patent is extended or adjusted under 35 U.S.C. 154(b) by 260 days.

(21) Appl. No.: 13/021,569

(22) Filed: Feb. 4, 2011

(65) Prior Publication Data

US 2011/0196595 A1 Aug. 11, 2011

Related U.S. Application Data

(60) Provisional application No. 61/302,065, filed on Feb. 5, 2010, provisional application No. 61/327,632, filed on Apr. 23, 2010.

(51) Int. Cl.
*F02D 11/02* (2006.01)

(52) U.S. Cl.
USPC ..... 701/107; 701/112; 123/399

(58) Field of Classification Search
USPC ..... 123/198 D, 198 DB, 399; 73/114.36; 701/107, 112, 114, 115
See application file for complete search history.

(56) References Cited

U.S. PATENT DOCUMENTS

| | | | | |
|---|---|---|---|---|
| 4,371,051 | A * | 2/1983 | Achterholt | 180/271 |
| 5,016,587 | A * | 5/1991 | Berger et al. | 123/359 |
| 5,018,383 | A | 5/1991 | Togai et al. | |
| 5,054,570 | A * | 10/1991 | Naito et al. | 180/170 |
| 5,121,723 | A * | 6/1992 | Stepper et al. | 123/322 |
| 5,150,681 | A * | 9/1992 | Kull et al. | 123/399 |
| 5,233,530 | A * | 8/1993 | Shimada et al. | 701/107 |
| 5,235,951 | A * | 8/1993 | Taguchi et al. | 123/397 |
| 5,482,024 | A * | 1/1996 | Elliott | 123/516 |
| 6,209,518 | B1 * | 4/2001 | Machida et al. | 123/396 |
| 6,230,094 | B1 * | 5/2001 | Ohashi et al. | 701/107 |
| 6,324,459 | B1 * | 11/2001 | Jung | 701/70 |
| 6,718,254 | B2 * | 4/2004 | Hashimoto et al. | 701/110 |
| 6,751,544 | B2 * | 6/2004 | Hashimoto et al. | 701/107 |
| 6,769,401 | B2 * | 8/2004 | Tachibana et al. | 123/406.13 |
| 6,881,174 | B2 * | 4/2005 | McCall | 477/107 |
| 6,883,496 | B2 * | 4/2005 | Suzuki et al. | 123/361 |
| 6,892,129 | B2 * | 5/2005 | Miyano | 701/107 |
| 7,133,762 | B2 * | 11/2006 | Sekita et al. | 701/107 |
| 7,254,472 | B2 | 8/2007 | Larsen et al. | |

(Continued)

FOREIGN PATENT DOCUMENTS

| | | |
|---|---|---|
| JP | 05-001588 | 1/1993 |
| JP | 09-287488 | 11/1997 |
| JP | 2005344665 A * | 12/2005 |

OTHER PUBLICATIONS

Toyota Motor Sales—http://www.autoshop101.com/forms/h33.pdf (Dec. 10, 2005).*

(Continued)

*Primary Examiner* — Stephen K Cronin
*Assistant Examiner* — Joseph Dallo
(74) *Attorney, Agent, or Firm* — Koppel, Patrick, Heybl & Philpott; Michael J. Ram

(57) ABSTRACT

A method and a device for interrupting unintended acceleration or unintended maintenance of vehicle speed comprising providing a driver operated fuel delivery disconnect system, said fuel delivery disconnect system comprising an electronic module programmed to temporarily disconnect electrical feed to a fuel delivery mechanism. The temporary interruption of the electrical feed places the vehicle in an idle mode without disrupting other vehicle control systems.

17 Claims, 9 Drawing Sheets

(56) References Cited

U.S. PATENT DOCUMENTS

| | | | | |
|---|---|---|---|---|
| 7,434,649 | B2 * | 10/2008 | Bolduc et al. | 180/279 |
| 2002/0020391 | A1 * | 2/2002 | Satou et al. | 123/396 |
| 2002/0107631 | A1 * | 8/2002 | Hirata | 701/107 |
| 2004/0007208 | A1 * | 1/2004 | Suzuki et al. | 123/399 |
| 2005/0027432 | A1 * | 2/2005 | Machida | 701/107 |
| 2005/0252493 | A1 * | 11/2005 | Simmons | 123/480 |
| 2007/0198165 | A1 * | 8/2007 | Hawkins et al. | 701/110 |
| 2008/0249698 | A1 * | 10/2008 | Yokoyama et al. | 701/107 |

OTHER PUBLICATIONS

International Preliminary Report on Patentability and Written Opinion of corresponding application PCT/US2011/000217, mailed Aug. 7, 2012.

* cited by examiner

SYSTEM FOR DISABLING ENGINE THROTTLE RESPONSE

This application claims benefit of U.S. Provisional Application No. 61/302,065 filed Feb. 5, 2010 and U.S. Provisional Application No. 61/327,632, filed Apr. 23, 2010.

BACKGROUND OF THE INVENTION

1. Field of the Invention

This invention relates to throttle control in vehicles, and more particularly to systems that prohibit unintended acceleration in vehicles.

2. Description of the Related Art

One typical system for control of a vehicle's engine throttle in modern vehicles is illustrated in FIG. 1 and shown schematically in FIG. 7. An Electronic Control Module ("ECM") 101 (referred to as "the car computer"and alternatively as "ECU"), illustrated as a microprocessor, receives electronic inputs from vehicle components such as the vehicle's transmission, cruise control, power steering, air conditioner, load (manifold absolute pressure (MAP), traction control, etc) and other remotely sent signals for processing and further component control, and may provide a voltage reference for such components. The ECM 101 also receives information indicating the position of the vehicle's accelerator pedal 114 through pedal input sensor 113. As is typical for motor vehicles, the accelerator pedal 114 enables driver control of the vehicle's motor, from engine idle to full throttle.

The ECM 101 is electrically connected to an Electronic Throttle Control Motor ("ETCM") 105 in a throttle body assembly ("TB") 112 to provide "drive-by-wire" electronic throttle control of the vehicle's motor. The ETCM 105, typically an electric motor, actuates a throttle plate 115 (represented by dashed lines) in the TB 112 that acts as a variable valve to control the amount of air flowing into the vehicle's motor for throttle control from idle to full throttle positions. Also connected to the ECM 101 is a throttle position sensor ("TPS") 103 in the TB 112 to provide engine throttle plate position feedback to the ECM 101. The TPS 103 converts physical position of the throttle plate within the TB 112 to an electrical signal for throttle feedback to the ECM 101. The TPS 103 includes a potentiometer 108, which provides a resistance, and wiper arm 107. Wiper arm 107 is in communication with the throttle plate 115. Potentiometer 108 is connected between lines 110, 111, and wiper arm 108 is connected to line 109. Line 110 is reference to ground. Lines 109, 110, 111, are connected to ECM 101.

BRIEF DESCRIPTION OF THE DRAWINGS

The components in the figures are not necessarily to scale, emphasis instead being placed upon illustrating the principals of the invention.

DETAILED DESCRIPTION OF THE INVENTION

An electronic failsafe device is disclosed for use in a system capable of degrading and disabling a vehicle engine's throttle response in a safe manner. The device is particularly useful to rapidly lower the RPM of an out-of-control high-revving engine to a safe and manageable idle speed.

Figure 2:
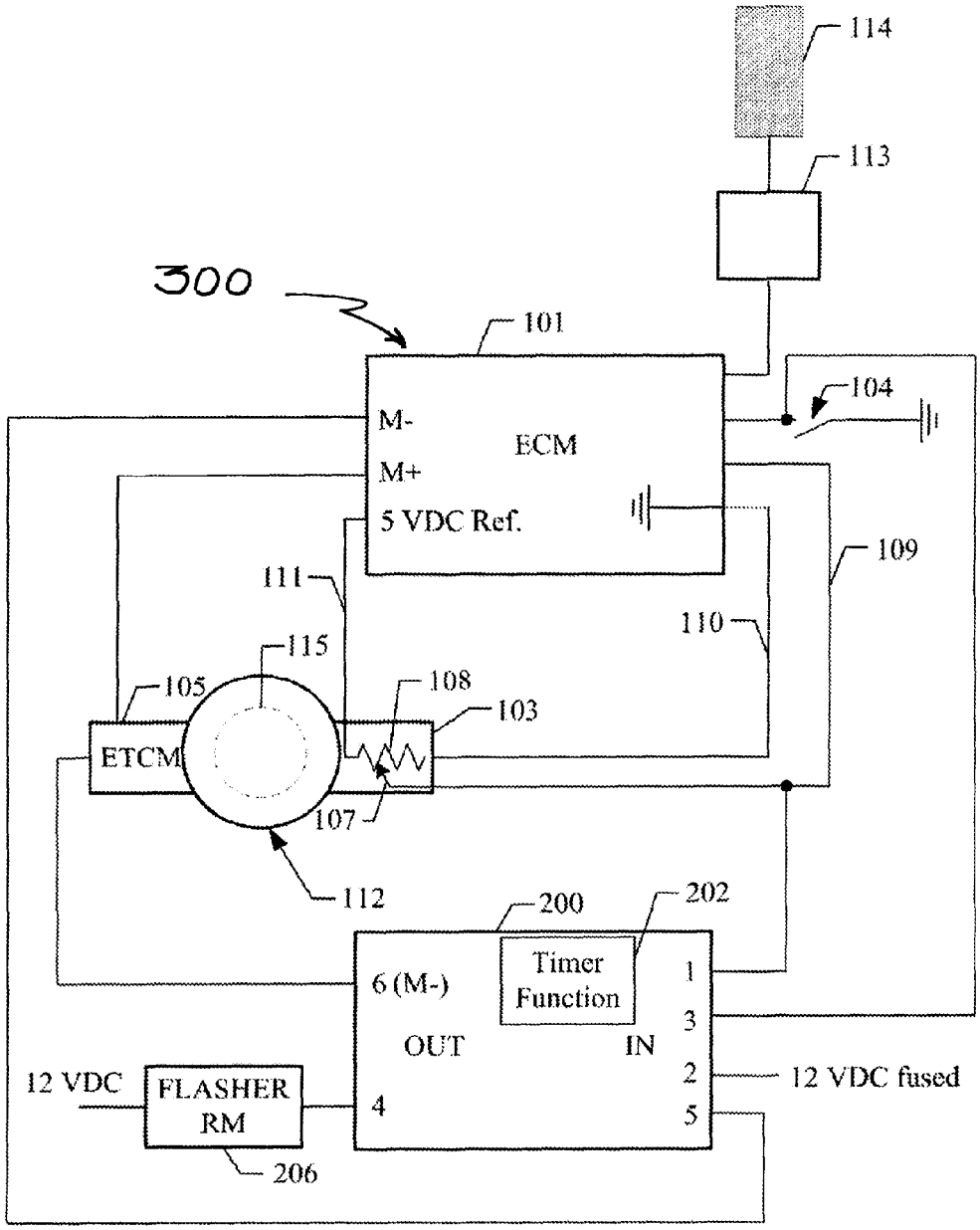
FIG. 2 is a block diagram illustrating one embodiment of an electronic failsafe device and system for degrading and disabling a vehicle's engine throttle response.

FIG. 2 illustrates one embodiment of an electronic fail safe system 300 that includes and electronic failsafe device 200 that is designed to prohibit unintended acceleration by, preferably, opening the negative side of the ETCM 105 electrical circuit. Under normal operating conditions, the TPS 103 sends a non-zero signal voltage to the ECM 101, typically varying in voltage from 0.5 vdc at idle (Idle) to 4.80 vdc at wide open throttle (WOT). As mentioned, above, the function of the TPS 103 is to mirror the position of the throttle plate within TB 112 and to transmit this information to ECM 101. Preferably, TPS 103 is a potentiometer and, with few exceptions, works on a 0-5 volt dc scale. As an example, at idle TPS 103 voltage will typically show 0.5 vdc and, depressing accelerator pedal 114, will smoothly and incrementally increase the voltage until reaching Wide Open Throttle (WOT). At WOT TPS 103 will typically send 4.8 vdc to ECM 101. Therefore, 50% of WOT will show approx. 2.0 vdc. When the failsafe device 200 receives greater than a threshold activation voltage, preferably 2.0 vdc or greater signal via TPS 103, this action will satisfy the first of two stages/requirements in order to activate the failsafe device to prohibit unintended acceleration. The second stage/requirement is preferably satisfied if the operator depresses the vehicle brake pedal 302 shown schematically in FIG. 8, causing the brake pedal switch 104 to contact to chassis ground to activate the failsafe device 200. If both stages/requirements are not detected by the failsafe device 200, the device 200 will not activate to interrupt the ETCM 105 electrical circuit, preferably by opening the negative side of the ETCM 105 electrical circuit. Or, the failsafe device 200 may be connected to open the positive side of the ETCM 105 electrical circuit. Thereby, with a TPS 103 signal of less than preferably 2.0 vdc the operator will be allowed to depress the brake pedal as normal without activation of the failsafe device 200. Likewise, with brake pedal switch 104 circuit open (brake pedal not depressed) the operator will be allowed to accelerate up to full throttle as normal without activation of the failsafe device 100. It is only when the 2.0 vdc or greater signal via TPS 103 AND brake pedal 104 is depressed that the failsafe device 200 is activated to open the negative side of the ETCM 105 resulting in the throttle body returning to drive the motor to an idle state. Failsafe device 200 through the use and implementation of an electrical switch, opens the negative side of ETCM 105 electrical circuit only when both stages/requirements are met.

The failsafe device 200 can be powered by a number of different sources, either singly or in combination to ensure uninterrupted power during an unintended acceleration event.

Direct Connect Power Supply: This method of supplying power to the failsafe device would require a direct line from the main 12V battery found in the vehicle to the failsafe device.

Secure Power Source: The failsafe device can also be supplied with a completely isolated power source not tied to the vehicle power system. This would include a rechargeable battery pack located under the dash of the vehicle supplying an uninterruptible power source to the failsafe device. This solution would isolate the failsafe device from all unknown power spikes or power loses during and unintended acceleration event.

The driver, by pressing the brake, allows the failsafe device to be powered to monitor for events. Possible events include monitoring the throttle position for a sensed level above a specified threshold through monitoring of the TPS signal or for a level outside of specified ranges. In alternative embodiments that do not depend on the TPS signal, the failsafe device may also respond to external signals such as a momentary switch in the cabin, the vehicle's hazard button in the cabin, a master cylinder pressure switch or a remote/satellite signal, MAP (manifold absolute pressure), engine RPM, vehicle speed, alternator (and other engine driven accessories) RPM sensor(s), crank and camshaft speed sensors, transmission torque converter speed sensor, air speed sensor (aviation use) or any other direct RPM/speed sensor data.

A timer function 202 in the failsafe device 200 maintains the negative side of ETCM 105 electrical circuit open for a predetermined delay, preferably 3-5 seconds (this duration is adjustable), and then preferably automatically deactivates (resets) and allows for standard vehicle functions after that time period. The 3-5 second "time-out" function stops any harsh/violent accelerations and decelerations (aka "bucking") in the event the problem persists. The failsafe device 200 will give the operator immediate control when confronted with unintended acceleration under many conditions (i.e. floor mat, transient electrical glitch, length of brake pedal, obstacle obstruction on accelerator pedal, component or components failure, voltage spike, human error, etc.) The emergency flashers deploy through flasher relay module 206 and reset automatically by timer function with the activation of the failsafe device 200.

Figure 3:
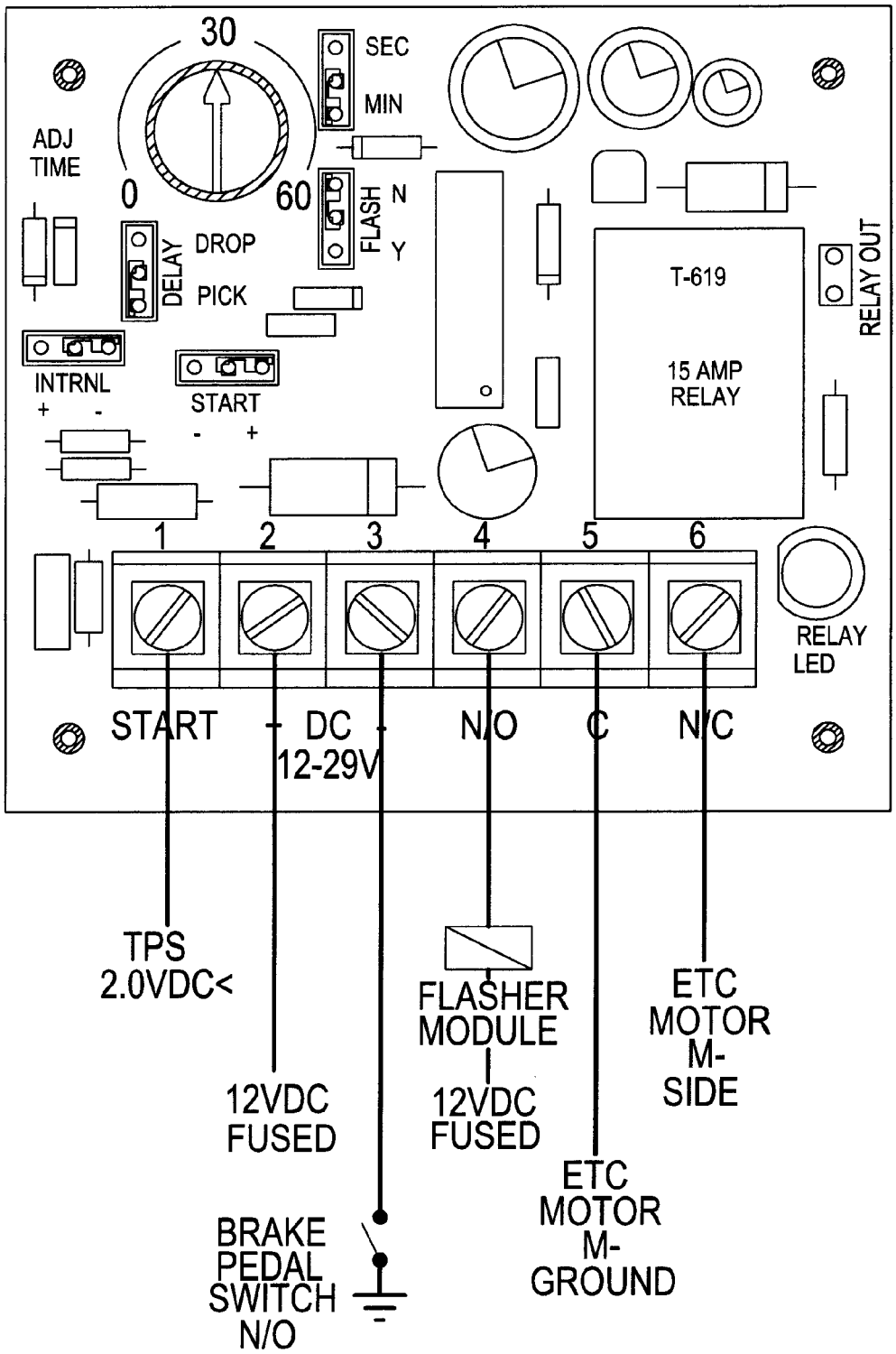
FIG. 3 is a top plan view illustrating, in one embodiment, the electronic failsafe device of FIG. 2.

FIG. 3 illustrates an overhead view of one implementation of the failsafe device 200 first illustrated in FIG. 2. Terminals 1-6 are provided for coupling to external components, with terminal reference numbers corresponding to the terminal reference number illustrated in FIG. 2.

Figure 4:
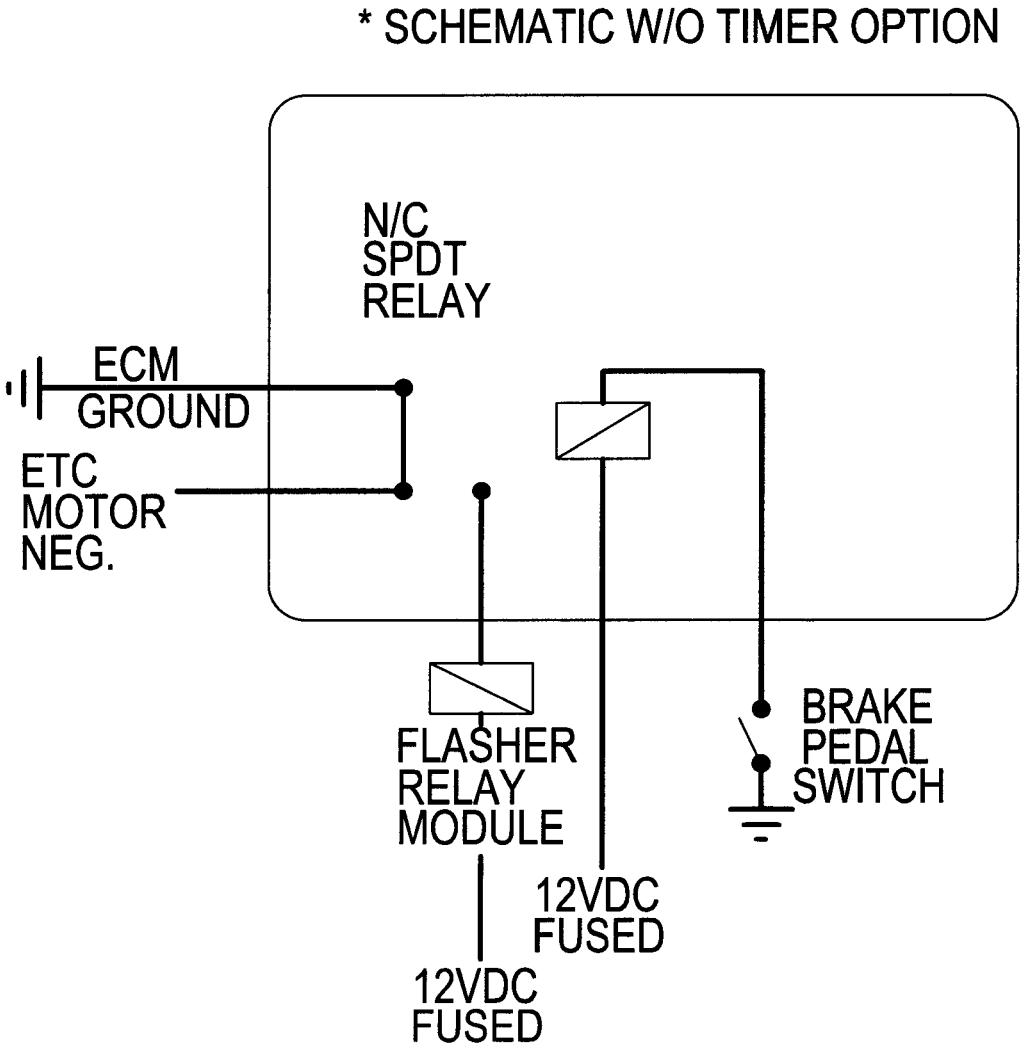
FIG. 4 is a schematic of one embodiment of an electronic failsafe device.

FIG. 4 is a schematic of one embodiment of an electronic failsafe device.

Figure 5:
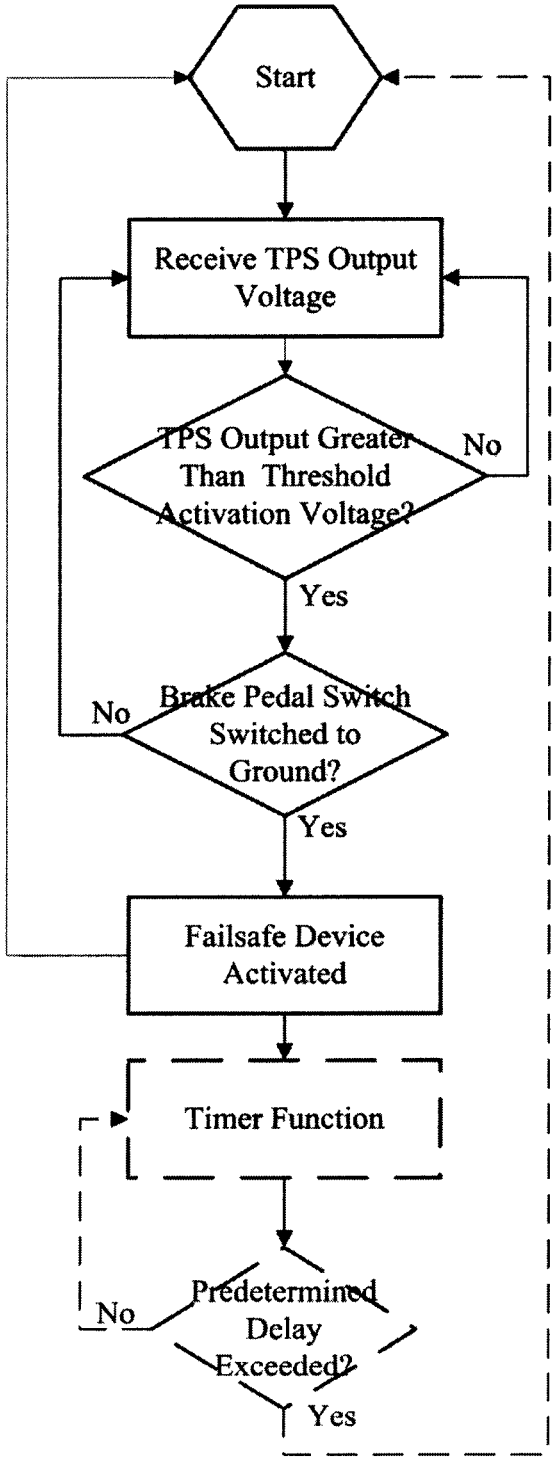
FIG. 5 is a flow diagram of, in one embodiment, stages/requirements to activate the failsafe device.

FIG. 5 is a flow diagram illustrating one embodiment of a method of using the failsafe device. A TPS output voltage is received by the failsafe device. If the TPS output voltage is greater than a threshold activation voltage, preferably greater than 1.4 vdc, and the failsafe device senses the brake pedal switch switched to ground, the failsafe device is activated.

Figures 6A, 6B, 6C:
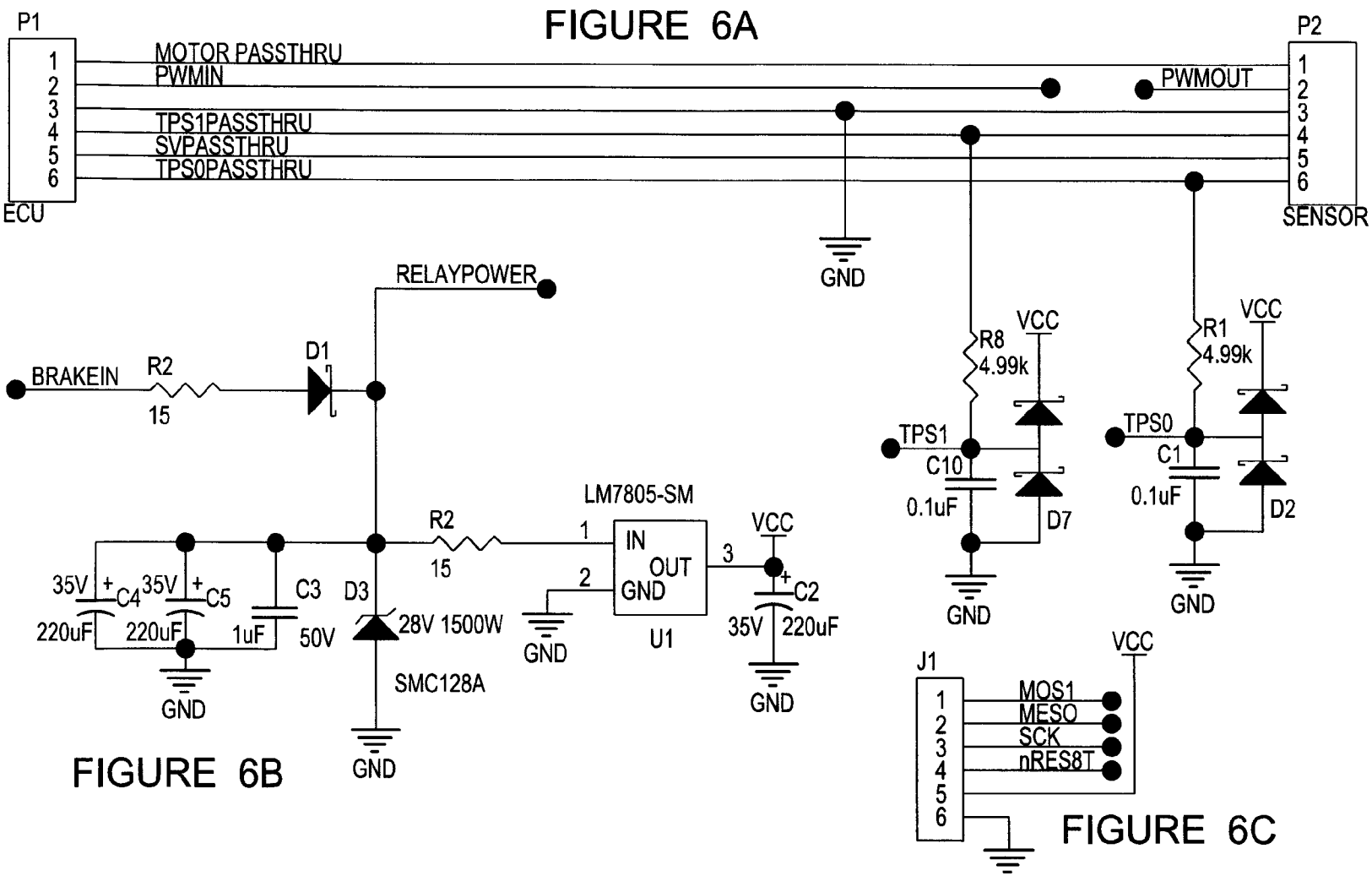
FIGS. 6A-6F is a schematic showing subcomponents of another embodiment of an electronic failsafe device.
Figures 6D, 6E, 6F:
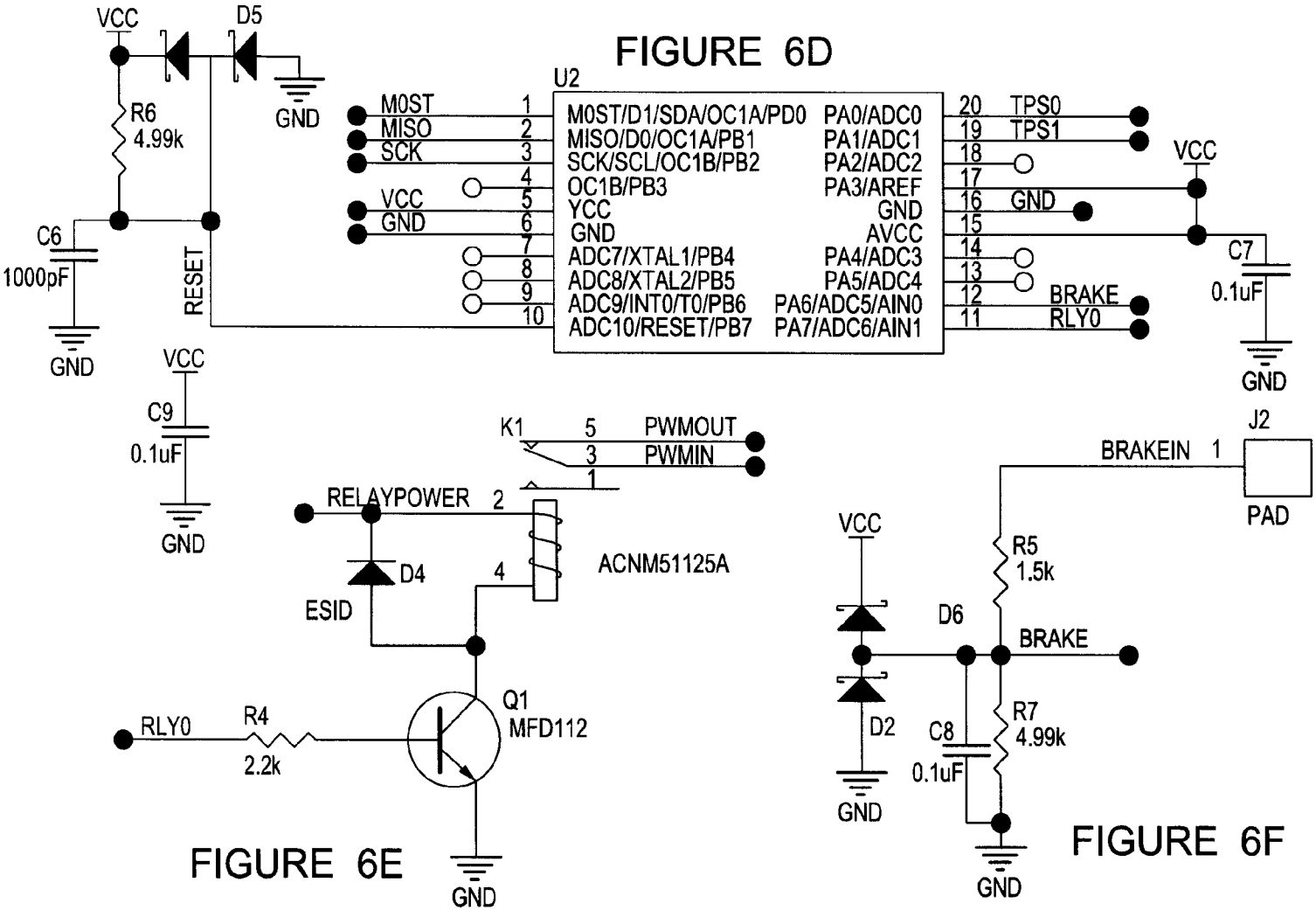

FIG. 6, shown as 6 subcomponents 6A, 6B, 6C, 6D, 6E, and 6F, is a schematic of another embodiment of the failsafe device comprising 6 subcompounds 6A- 6F that uses the vehicle's braking indicator (received at braking terminal) to power the failsafe device. Inherently, such an embodiment satisfies one of the two conditions necessary to activate the failsafe device described by FIG. 2 (i.e. application of the vehicle's brake). In FIG. 6, the label "SENSOR" is made in reference to the ETCM of FIG. 2. When a brake signal is active, a 12V supply is provided to module U1 through relaypower terminal via R3, with U1 converting the 12V to 5V for VCC. The relaypower terminal is provided by the braking indicator through R2 and D1, and it also charges storage capacitors C2, C3, C4, C5, C7 and C9 which provide filtering for the 12V and VCC signal. VCC supplies power to microprocessor U2 and supporting circuitry of the failsafe device such as signal conditioning D2, D6 and D7, and power-on reset (D5, R6, C6) for the module U2. TPS signals are monitored through terminals TPS 0 and TPS 1 for an event that requires deceleration, such as receipt at TPS0 of a voltage greater than approximately 1.4 vdc. Or, terminal TPS1 may also be in communication with potentiometer 108 of FIG. 2 in an inverted voltage relationship to TPS0 to enable redundancy checking of the TPS signal. For example, if TPS0 represents a potentiometer throttle position of 10%, then the signal at TPS1 would represent a throttle position of 90% in a normal operating condition. If the correlation is detected to be out of specification, the "second condition" is satisfied and the failsafe device would be activated.

Once the second condition is satisfied, the failsafe device switches Q1 on via R4 to activate the relay K1, preferably using a pulse width modulation ("PWM") switching scheme based on elapsed time ("Programmable Modulated Throttle control technology") to ensure that the TPS signal does not trigger in the ECM a vehicle "limp mode." Or, such PWM switching of the relay K1 may be based on amplitude of the detected TPS signal, such as "switch off" in response to receipt of a TPS signal passing approximately 0.5 vdc and "switch on" if such signal again exceeds approximately 1.4 vdc ("Adaptive Firmware Throttle Control"). In other embodiments, suitable voltages may be used that correspond to the applicable vehicle of interest. Preferably, both switching modes may be realized in the failsafe device.

The Adaptive Firmware Throttle Control is software loaded onto the processor U2 to automatically adjust timing for periodic interrupt of the duty cycle of the ETMC circuit help the driver regain control of the vehicle. The Programmable Modulated Throttle Control is a set of values, such as timing for the periodic interrupt of the ETCM circuit that are pre-programmed into the module U2.

Both the hardware and software of the failsafe device when activated will provide filtering of the TPS signals to reduce false triggering, such as through R1/C1, R8/C10, R5/R7/C8 and software detection in module U2. This condition is done to prevent false triggering of the failsafe device adding additional safety conditions for the driver.

The failsafe device will also be equipped with an event logging system implemented in the module U2. This logging system will detect when an event takes place and log that date and time into a memory device. All relevant information (power supply voltage, TPS signals, time reference data, and location) will be stored into the memory device.

The device will have a dual color LED (not shown) to facilitate initial installation. For example, once the device is installed and powered, the failsafe device may look for signals indicating a normal operating condition and provide visual feedback to the installer through the dual color LED.

Programming capability for the module U2 is provided through connector J1 that allows the software to be loaded into the failsafe device.

Figure 1:
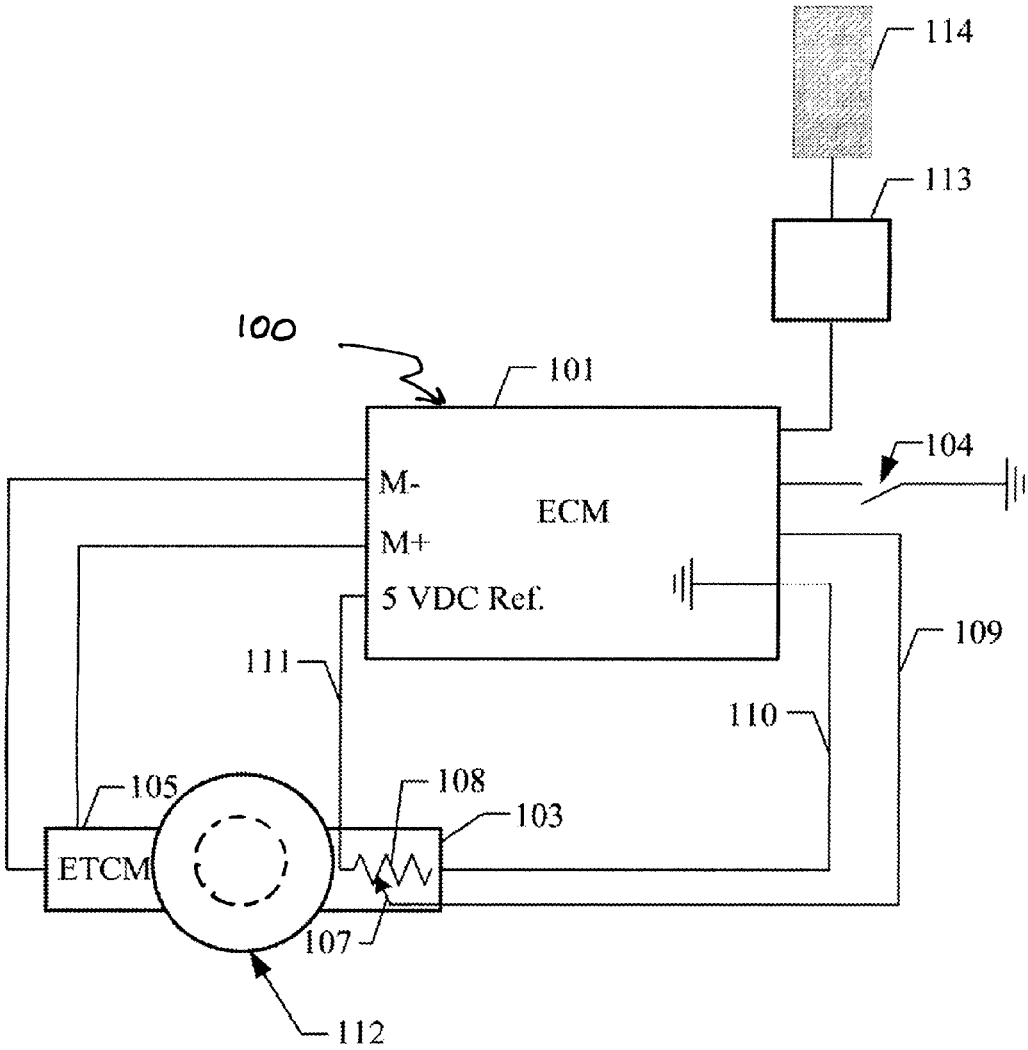
FIGURE 1 (PRIOR ART)
FIG. 1 is a block diagram illustrating a prior art throttle control system for vehicles.
Figure 7:
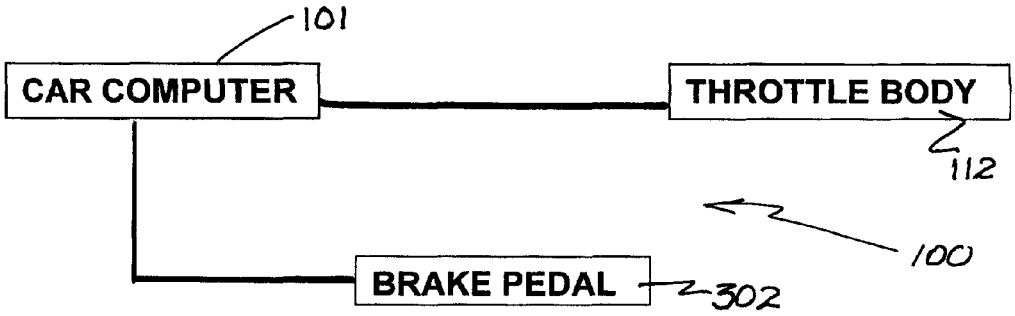
FIGURE 7 (PRIOR ART)
FIG. 7 is a diagram illustrating a throttle body and brake in a prior art configuration with a vehicle's ECM.

FIG. 7 is a block diagram illustrating a prior art system 100 including a throttle body 112 and brake pedal 302 in a configuration with a vehicle's ECM such as shown in FIG. 1.

Figure 8:
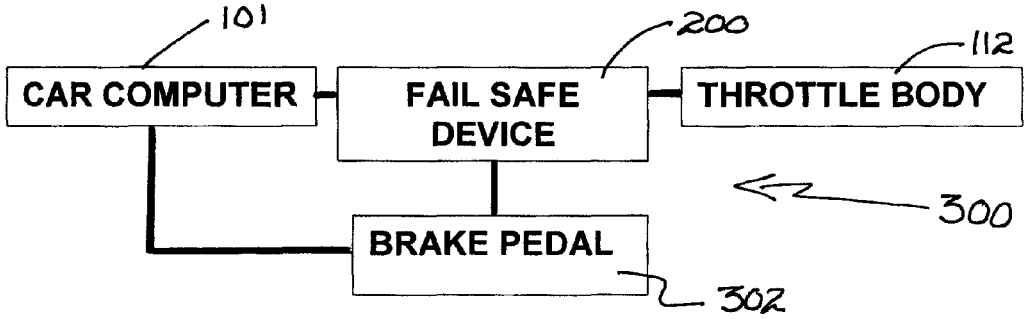
FIG. 8 is a diagram illustrating one embodiment of a system having a throttle body in communication with a car computer through a failsafe device.

FIG. 8 is a diagram illustrating an embodiment of a system 300 having a throttle body 112 in communication with an ECM 101 (a car computer) through a failsafe device 200 such as shown in FIG. 2

Figure 9:
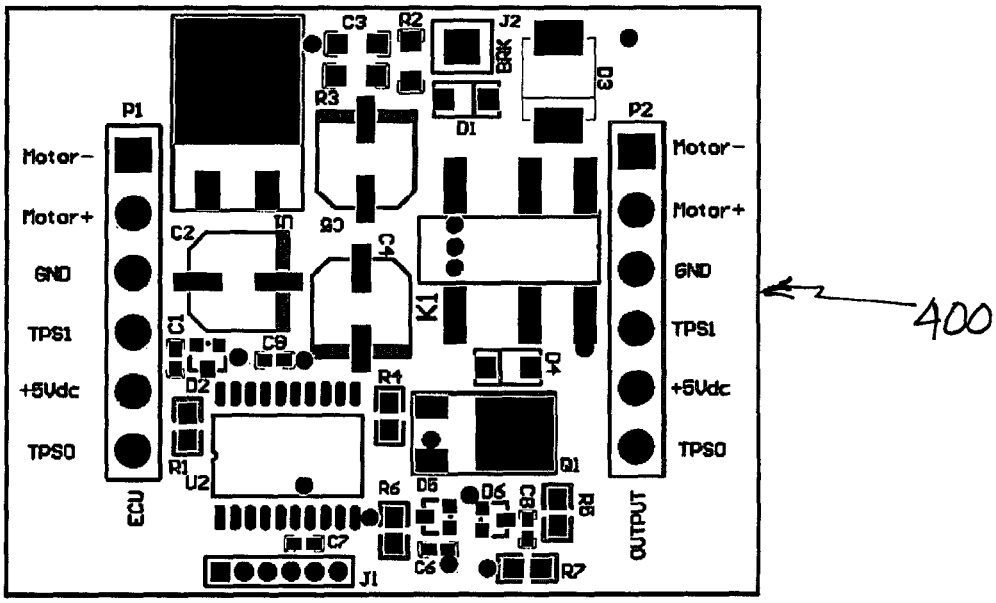
FIG. 9 is a top plan view of a printed circuit board ("PCB") for the failsafe device illustrated in FIGS. 6A-6F.

FIG. 9 is a top plan view of a printed circuit board ("PCB") 400 for the failsafe device 200 illustrated in FIGS. 6A-6F.

While various implementations of the application have been described, it will be apparent to those of ordinary skill in the art that many more embodiments and implementations are possible that are within the scope of this invention. For example, the fail safe system described herein is not limited to a throttle system. It is contemplated that the control systems described herein can be used on other fuel delivery systems including, but not limited to variable speed fuel pumps and the like. All references herein to an ETCM can be replaced by a more general reference to an electronic fuel delivery control module (EFCM). In such an instance a fuel feed rate sensor (FFRS) replaces the throttle position sensor (TPS). Based on the teachings herein, one skilled in the art can readily understand and implement the disclosed fail safe system on any vehicle having a fuel delivery and quantity control system.

I claim:

1. An improved fail safe device for disabling a vehicle engine fuel delivery system so as to prohibit unintended acceleration or uncontrolled speed in a vehicle the fuel delivery system comprising a) an Electronic Control Module ("ECM"), said ECM receiving electronic inputs from the vehicle components comprising the vehicle's accelerator pedal through a pedal input sensor, said ECM electrically connected to an engine fuel delivery control module (EFCM) to provide drive-by-wire electronic throttle control of the vehicle's motor, the EFCM having a negative side and a positive side, b) a throttle position sensor ("TPS") sensing the engine throttle plate position and transmitting said position information to the ECM as an electrical signal correlated to said throttle plate position, the TPS electrical signal comprising a non-zero signal voltage varying from about 0.5 vdc at idle (Idle) to about 4.80 vdc at wide open throttle, or c) fuel feed rate sensor (FFRS) sensing the fuel feed rate and transmitting said information to the ECM as an electrical signal correlated to said feed rate, the FFRS electrical signal comprising a non-zero signal voltage varying from about 0.5 vdc at idle to about 4.80 vdc at maximum fuel feed rate the improvement comprising an electronic throttle disconnect or fuel feed reduction device electrically connected between a brake pedal and a fuel feed mechanism such that, following activation, depressing the brake pedal opens the electrical circuit on the negative side or positive side of the EFCM to place the vehicle in an idle position.

2. The improved fail safe device of claim 1 wherein the TPS or FFRS is a potentiometer operating on a 0-5 volt dc scale.

3. The improved fail safe device of claim 1 wherein the electronic throttle disconnect or fuel feed reduction device is activated by the delivery of a threshold activation voltage from the TPS or FFRS followed by the vehicle operator depressing the vehicle brake pedal so as to cause a switch in communication with the brake pedal to contact a chassis ground.

4. The improved fail safe device of claim 3 wherein the threshold activation voltage is greater than about 2.0 vdc.

5. The improved fail safe device of claim 3 such that as long as the TPS signal does not exceed the threshold activation voltage the brake pedal can be depressed without activation of the failsafe device and the vehicle operator can accelerate up to full speed without activation of the failsafe device.

6. The improved fail safe device of claim 1 wherein the electrical power for operating the fail safe device is provided a 12V battery supplying power to the vehicle.

7. The improved fail safe device of claim 1 wherein the electrical power for operating the fail safe device is provided an isolated power source separate from a source of electrical power for the vehicle.

8. The improved fail safe device of claim 7 wherein the electrical power source is a rechargeable battery pack located within the vehicle so as to supply an uninterruptible power source to the failsafe device.

9. The improved fail safe device of claim 1 configured to respond to an alternative control source comprising signals from a separate switch in the passenger portion of the vehicle, a vehicle hazard button, a master cylinder pressure switch or a remote or satellite signal activated switch, a manifold absolute pressure detector, elevated engine RPM, vehicle speed, an alternator or other engine driven accessories, an RPM sensor, crank or camshaft speed sensors, transmission torque converter speed sensors, air speed sensors or other direct RPM/speed sensor data.

10. The improved fail safe device of claim 1 further including a timer function configured to maintain the electrical circuit to at a normal vehicle operation setting for a predetermined delay after activation.

11. The improved fail safe device of claim 1 wherein the fail safe device is automatically reset to said normal operation setting if the activation is reversed prior to the end of said predetermined delay time period.

12. The improved fail safe device of claim 10 wherein the predetermined delay is adjustable.

13. The improved fail safe device of claim 10 wherein the predetermined delay is from about 3 to about 5 seconds.

14. The improved fail safe device of claim 1 further including an electrical connection configured to activate a vehicles emergency flashers if the failsafe device is activated.

15. A method of interrupting unintended acceleration or unintended maintenance of vehicle speed comprising:

providing a driver operated fuel delivery disconnect system, said fuel delivery disconnect system comprising an electronic module programmed to temporarily disconnect electrical feed to a fuel delivery mechanism wherein the temporary interruption of the electrical feed places the vehicle in an idle mode without disrupting other vehicle control systems.

16. The method of claim 15 wherein the fuel delivery system is a throttle system or and electronically controlled fuel pump.

17. The method of claim 15 wherein said temporary disconnect by the electronic module is activated after a preset time delay, by depression of the brake pedal by the vehicle operator.

* * * * *